United States Patent [19]

Wells et al.

[11] Patent Number: 4,682,394

[45] Date of Patent: Jul. 28, 1987

[54] BEDDING AND SEATING PRODUCT HAVING DOUBLE TWIST COIL SPRING AND METHOD AND APPARATUS FOR MANUFACTURING THE SAME

[75] Inventors: Thomas J. Wells, Carthage, Mo.; Angelo Serafini, East Boston, Mass.

[73] Assignee: Leggett & Platt, Incorporated, Carthage, Mo.

[21] Appl. No.: 907,675

[22] Filed: Sep. 15, 1986

Related U.S. Application Data

[62] Division of Ser. No. 769,947, Aug. 27, 1985, Pat. No. 4,639,957.

[51] Int. Cl.[4] ..... B21F 35/02

[52] U.S. Cl. ..... 29/173; 72/138; 72/139

[58] Field of Search ..... 29/173; 72/138, 139, 72/142, 143, 144; 140/92.2, 102

[56] References Cited

U.S. PATENT DOCUMENTS

| | | | |
|---|---|---|---|
| 136,473 | 3/1873 | Ward | 5/256 |
| 197,405 | 11/1877 | Read | 5/256 |
| 198,833 | 1/1878 | Barmore | 5/256 |
| 1,839,325 | 1/1932 | Marquardt | 5/256 |
| 2,014,833 | 9/1935 | Burns | 72/142 |
| 2,607,582 | 8/1952 | Jurgens | 267/180 |
| 2,631,840 | 3/1953 | Bugenhagen | 267/180 |
| 3,342,223 | 9/1967 | Hall et al. | 140/102 |
| 3,470,721 | 10/1969 | Scheublein, Jr. et al. | 72/144 |
| 3,825,960 | 7/1974 | Inman et al. | 5/247 |
| 3,833,948 | 9/1974 | Surletta | 5/247 |
| 3,835,485 | 9/1974 | Klicki | 5/247 |
| 3,847,379 | 11/1974 | Stumpf | 267/91 |
| 3,990,121 | 11/1976 | Whitaker | 5/260 |
| 4,053,956 | 10/1977 | Higgins | 5/255 |
| 4,112,528 | 9/1978 | Higgins | 5/248 |

FOREIGN PATENT DOCUMENTS

| | | | |
|---|---|---|---|
| 2015659 | 10/1970 | Fed. Rep. of Germany . | |
| 427118 | 4/1935 | United Kingdom . | |
| 708093 | 4/1954 | United Kingdom | 72/142 |

*Primary Examiner*—Percy W. Echols

*Attorney, Agent, or Firm*—Wood, Herron & Evans

[57] ABSTRACT

A bedding foundation box spring having novel double twist coil springs interconnecting a wooden base frame and a top wire grid. The coil springs each comprise a single length of wire having a middle section located in a diametral plane of one end convolution of the spring and a pair of spring arms coiled in the same rotational direction from opposite ends of the middle section. Each of the spring arms is formed into a helix of varying pitch which terminates in a free end of the spring arm. The free ends of the two spring arms of each coil are located on opposite sides of the end convolution of the coil and are secured to the wire grid. The novel coils are manufactured by inserting a straight length of wire through a stationary pair of forming dies and a mandrel located between the dies. With the middle of the straight length of wire located in the mandrel, the mandrel is then simultaneously rotated and moved axially while the ends of the length of wire are pulled through the stationary forming dies.

7 Claims, 12 Drawing Figures

| REVOLUTIONS | RISE | ACCUMULATIVE RISE | PITCH PER 1 REV. |
|---|---|---|---|
| 2 | 0 | 5.500 | 0 |
| 1 3/4 | 0.177 | 5.500 | 0.708 |
| 1 1/2 | 1.032 | 5.323 | 4.12 |
| 1 1/4 | 1.785 | 4.291 | 7.14 |
| 1 | 1.525 | 2.506 | 6.1 |
| 3/4 | 0.785 | 0.981 | 3.14 |
| 1/2 | 0.196 | 0.196 | 0.784 |
| 1/4 | 0 | 0 | 0 |
| 0 | 0 | 0 | 0 |

BEDDING AND SEATING PRODUCT HAVING DOUBLE TWIST COIL SPRING AND METHOD AND APPARATUS FOR MANUFACTURING THE SAME

This is a division of application Ser. No. 769,947, filed Aug. 27, 1985, now U.S. Pat. No. 4,639,957.

This invention relates to bedding and seat springs, and more particularly to an improved bedding and seat coil spring as well as a method and apparatus for manufacturing this improved bedding and seat coil spring.

Traditionally, bedding and seat springs have been shaped as round helical coil springs positioned in a vertical orientation and arranged in matrixes or spring assemblies so as to provide vertical resilient support for an object resting atop the assembly. Generally, coil springs differ from one application to another, as for example, in height, resiliency or firmness, deflection and durability, but in nearly every application an attempt is made to obtain the desired resiliency deflection and durability characteristics in a spring of minimum expense. The expense or cost of a coil spring is primarily attributable to the length of the wire, the gauge or thickness of the wire, the ductility, and the tensile strength of the wire.

In an effort to reduce the cost of bedding or seating springs while still retaining desired resiliency, deflection, and durability characteristics, efforts have been made to depart from a round helical coil spring configuration and to substitute instead a formed wire spring. "Formed wire spring" is a term of art used to describe springs which derive their resiliency from torsion bars rather than coils. Examples of formed wire springs embodied in bedding spring products are to be found in U.S. Pat. Nos. 3,825,960; 3,833,948; and 3,835,485. Additionally, some prior art spring assemblies have been developed which included combinations of coils and formed wire springs, as for example, the box spring assembly shown in U.S. Pat. No. 3,990,121.

While formed wire springs which utilize torsion bars rather than coils to derive the resiliency of the spring generally employ less wire than coil springs of comparable height, resiliency, deflection and durability, they often cost more to produce. The material savings is all too often offset or outweighed by increased production costs. These increased production costs are attributable to the equipment upon which formed wire springs are made. This equipment is generally capable of making only one bend or torsion bar per stroke or reciprocation of a bending machine. Since formed wire springs generally utilize many bends and many separate torsion bars throughout the length or height of a single spring, the machinery for manufacturing formed wire springs is usually relatively expensive and very slow in operation. Consequently, formed wire springs generally make up in manufacturing costs any savings attributable to the use of less material or less costly material.

It has therefore been an objective of this invention to provide an improved spring which utilizes less material than a conventional round helical coil spring to achieve a particular desired resiliency, deflection, and durability, but which is not subject to the inherent slow and expensive manufacturing requirements of conventional formed or torsion bar wire springs.

Still another objective of this invention has been to provide an improved bedding or seating spring which is characterized by the material savings of a formed torsion bar wire spring but which may be manufactured on relatively high speed manufacturing equipment without the need to separately bend a plurality of torsion bars to form a single spring.

Still another objective of this invention has been to provide a round or coiled spring which has the firmness and deflection characteristics of a formed wire spring but without many inherent disadvantages of conventional coil springs. One limiting characteristic of a conventional coil spring is that it is unbalanced from one side to the other. That is, the resiliency of the spring on one side of the axis of the spring is different from the resiliency of the spring on the other side. This imbalance is attributable to the presence of a knot in at least one end turn or convolution of the coil. Conventional knotted coil springs are more firm on the knotted side of the coil and more resilient or soft on the side of the coil away from the knot. This imbalance of the resiliency characteristics of the coil presents numerous manufacturing and product problems. Among the product problems are soft spots in the resulting spring product, as well as side sway created by the firm side of the coils all being similarly oriented in a matrix of springs or a so-called spring assembly. As a result of the knots of the coils all being similarly oriented, the top plane of a spring assembly tends to move or sway in one direction more easily than in another.

The knot of a knotted coil spring also adds to the expense of the wire used in the manufacture of the product. In order to form the knot, the wire must be substantially more ductile and consequently, more expensive than would otherwise be required in an unknotted coil of the same firmness.

Another problem attributable to a knotted end turn or convolution of a coil spring is the difficulty in assembly which it creates because the knotted end turn has a fixed dimension or diameter which often varies from one spring to another. This differing dimension makes it difficult to secure the varying diameter coils to one another and to other components of a bedding or seating spring product.

It has therefore been another objective of this invention to provide an improved coil spring which eliminates the knot characteristic of most prior art coil springs and which has a double spring arm for connection to adjacent springs or to other components of the spring assembly and which is characterized by equal balance or firmness on either side of the spring.

Still another objective of this invention has been to provide an improved coil spring which is not limited to a fixed end turn dimension and which therefore is amenable to large manufacturing tolerances on the part of the components to which it is attached in a spring assembly.

One aspect of this invention is predicated on a novel double twist coil spring which achieves these objectives. The coil spring comprises a middle straight length of wire located in a diametral plane of one end convolution of the coil and from the opposite ends of which there extend a pair of spring arms coiled in the same rotational direction and formed into a helix which varies in pitch from the one end convolution toward an opposite end. At the opposite end of the coil spring, the spring arms terminate in a pair of opposed free ends adapted to be connected to a welded wire grid of a box spring, mattress, or a seating product.

Yet another aspect of this invention is predicated upon the method by which this new improved double twist coil is manufactured. According to this aspect of the invention, a straight length of wire is inserted through a pair of forming dies and through a rotatable mandrel located between the dies. The mandrel is then rotated and simultaneously moved axially relative to the non-rotating forming dies so that the coil spring wire is progressively wrapped around the mandrel. This movement results in the formation of a coil spring having one end turn or convolution across the diameter of which there extends a straight bar and a pair of spring arms coiled in the same rotational direction extending from the opposite ends of the straight middle bar. In the practice of this forming method, the velocity of the axial movement of the mandrel is increased over a major portion of the length of the spring relative to the rotational speed of the mandrel as the spring is formed. This relative velocity change results in a helical double twist coil being formed of increasing pitch from the initially formed end turn or convolution toward a point close to the opposite end. According to the practice of this invention, the free ends of the helically wound spring arms of the spring then have straight flats formed thereon so as to create connecting flats by means of which the two arms of the spring may be connected to a welded wire grid or other conventional top plane connection of a bedding or seating product.

Yet another aspect of this invention is predicated upon the apparatus or machine for manufacturing this double twist coil spring at a single station of the machine. This apparatus comprises a pair of forming dies between which there is located a rotatable mandrel. When a straight length of wire is inserted through apertures in the forming dies and through a slot in one end of the mandrel, the mandrel may be rotated and simultaneously moved axially relative to the forming dies so that the wire is progressively wrapped about the mandrel. This relative movement results in a coil having a diametrically extending middle section and a pair of ends coiled in the same rotational direction from opposite ends of the middle section. This machine includes a cam for controlling and increasing the axial speed of the mandrel over the major portion of the length of its stroke while the rotational speed of the mandrel remains unchanged. As a result, the pitch of the resulting helically wound spring is increased from the initially formed end convolution of the spring for the major portion of the length of the spring. Before the free ends of the straight wire are disengaged from the forming dies, a pair of movable dies cooperable with the stationary dies are actuated so as to form bent end sections on each of the free ends of the spring arms.

The primary advantage of the method and apparatus utilized in the practice of this invention is that it enables the improved coils springs of this invention to be very quickly and inexpensively manufactured on relatively inexpensive machinery. Furthermore, the resulting coil spring which is derived from the practice of this invention, is characterized by improved resiliency, deflection, and durability over any other coil spring containing a comparable quantity of wire or material.

These and other objects and advantages of this invention will be more readily apparent from the following description of the drawings in which.

Figure 1:
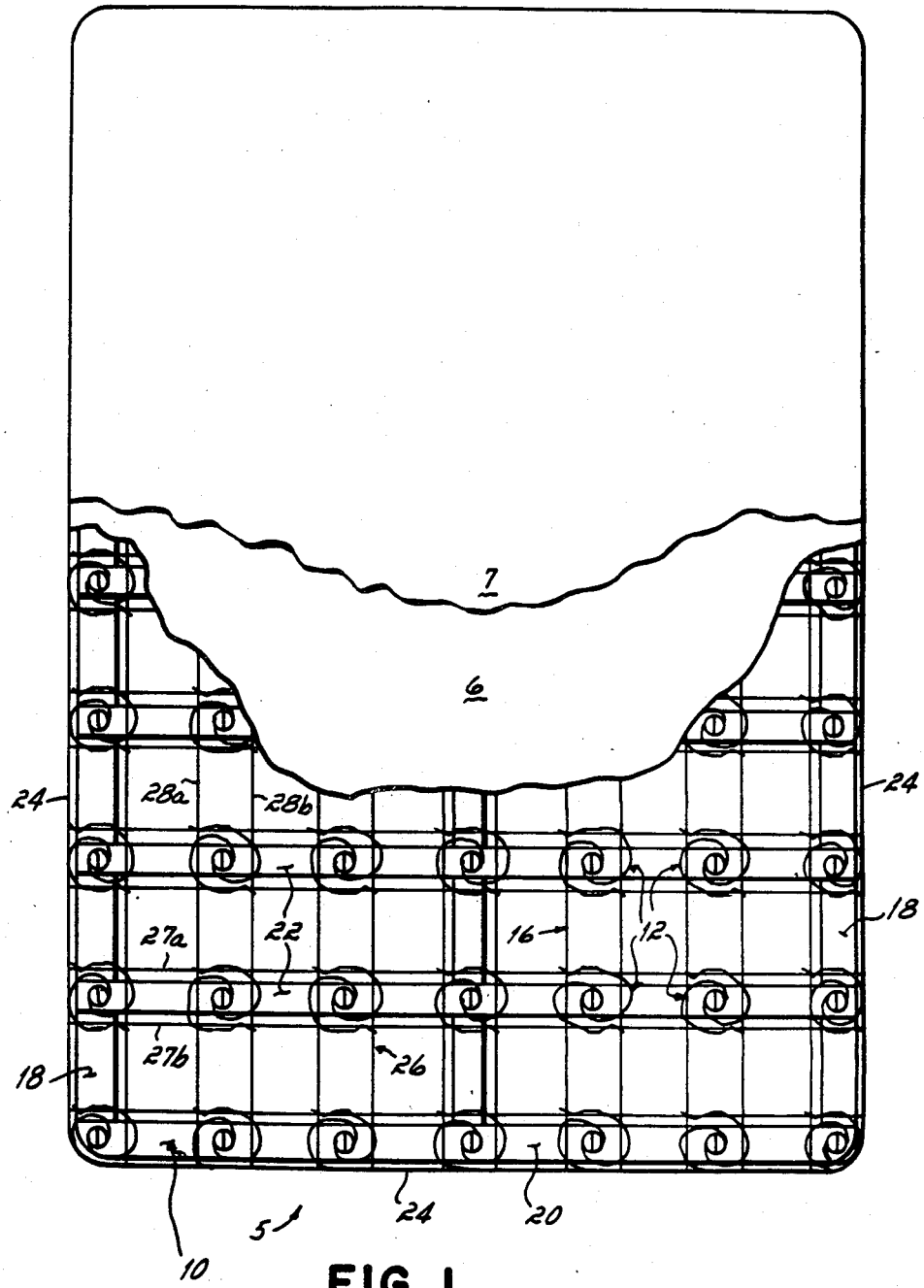
FIG. 1 is a top plan view, partially broken away, of a box spring bedding foundation incorporating the invention of this invention.
Figure 2:
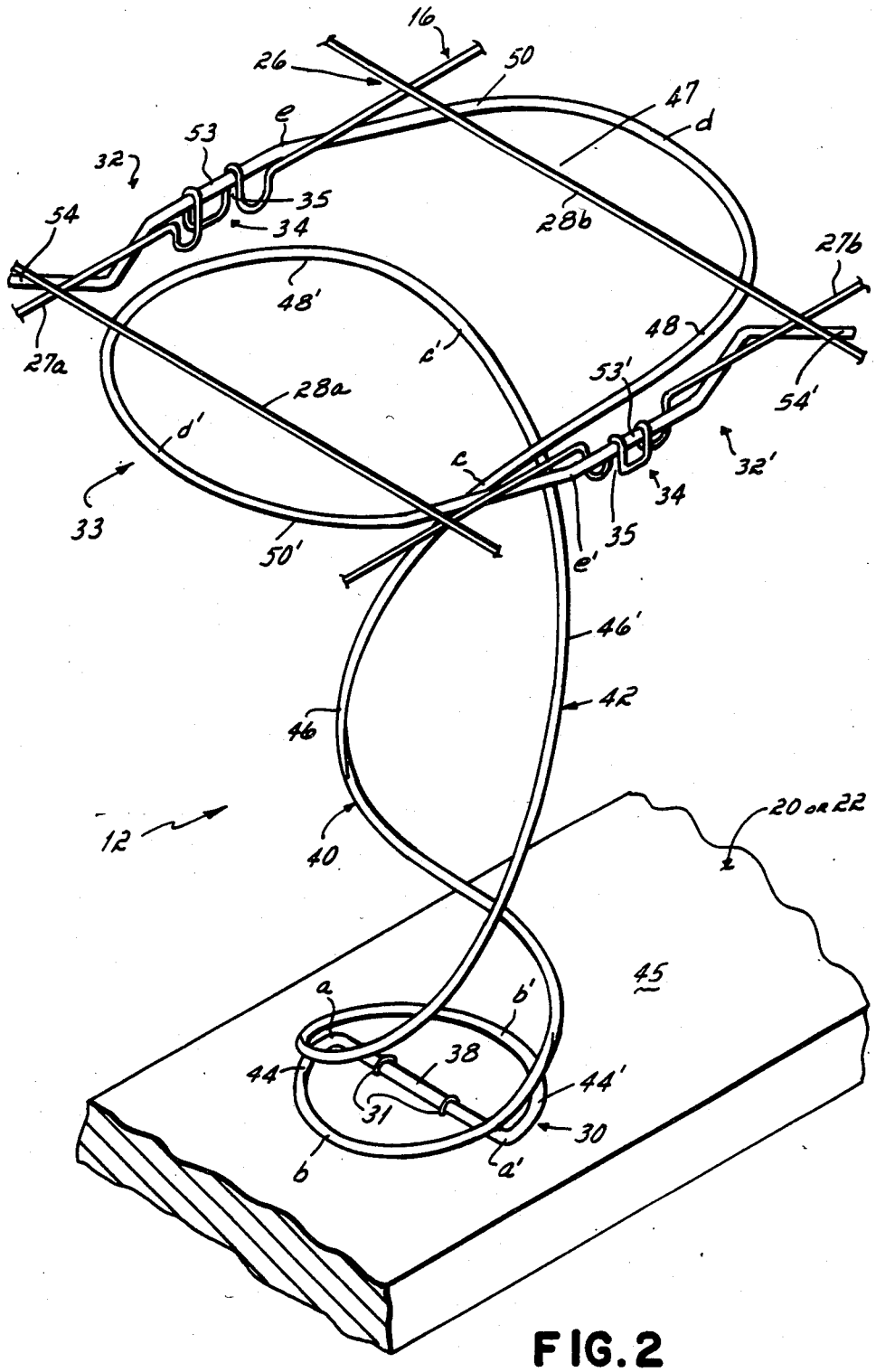
FIG. 2 is an enlarged perspective view of a portion of the box spring of FIG. 1 including the novel coil spring utilized in that box spring.

With reference first to FIGS. 1 and 2, it will be seen that the box spring assembly 5 comprises a wooden base frame 10 on the top of which there is mounted a plurality of coil springs 12 for supporting a top wire grid 16. The top wire grid is intended to resiliently support a mattress as is conventional in the bedding industry. A fabric pad 6 is fixed on the grid 16 and the entire assembly is enclosed by a cover 7.

The base frame 10 is rectangular in configuration and comprises a pair of longitudinally extending side boards 18 as well as a pair of transversely extending end boards 20 nailed or otherwise secured to the top of the side boards 18. Additionally, there is a plurality of wooden slats 22 which extend transversely across the rectangular base between the side boards 18. These slats are also nailed or otherwise fixedly secured to the top of the side boards 18.

The top wire grid 16 comprises a border wire 24 and a welded wire grid 26. The border wire 24 is formed into a rectangular configuration and overlies the peripheral edge of the base frame. The welded wire grid 16 is secured to and located in the plane of the border wire 24, the grid and border wire together defining the top plane of the box spring assembly. The welded wire grid comprises a plurality of pairs 27*a*, 27*b* of transverse wires and a plurality of pairs 28*a* and 28*b* of longitudinal wires, which wires all extend between opposite sides and ends of the rectangular border wire 24. These pairs 27, 28 of grid wires are adapted to overlie and cooperate with the rows and columns of coil springs 12 so as to secure the top of those springs 12 against lateral and longitudinal displacement.

The ends of all the grid wires 27, 28 are hooked around the border wire and are preferably welded to the border wire. The intersections or cross-over points of the transverse wires 27 and longitudinal wires 28 are welded together, thereby providing an integral welded wire grid. In manufacture, the border wire 24 and the welded wire grid 26 are all preformed into a welded top wire grid sub-assembly 16 which, after attachment of the coil springs 12 to the wooden frame 10, is overlaid on the top of the coil springs and attached as a sub-assembly to the coil springs. Alternatively, the welded grid assembly 16 may be attached to the coil springs 12 and the sub-assembly of grid and coils attached to the wooden frame 10.

The coil springs 12 utilized in the box spring assembly 5 of this invention are, as explained more fully hereinafter, all unique or novel. These coil springs are of the single cone type which have their small ends or small convolutions 30 fixedly attached to the top of one of the slats 22 or the end boards 20 by staples 31. The free ends 32 of the spring arms of each coil spring 12 are fixed to the wire grid by crimps or hooks 34 formed in the transverse wires 27 of the wire grid 16. Each transverse wire 27 of each pair of transverse wires (each such pair serving a row of coil springs in the box spring assembly) is provided with a plurality of double reversely bent hooks 34 preformed into that transverse wire of the welded wire grid. Each hook 34 is formed as an open U-shaped element which opens downwardly so that the grid 16 may be placed over the coil springs with each top convolution of each of the coil springs located in two such hooks. The open portion of each U-shaped configured hook is then bent or crimped to a closed condition so as to lock the free ends 32 of the spring arms of the coil springs 12 within the U-shaped section of the hooks of the transverse wires and thereby interconnect the coil springs 12 with the top wire grid. Thus, each coil spring 12 is fixed only to the transverse grid wires of the welded wire grid and not to the longitudinal grid wires which overlie, but are not secured to, the top of the coil springs.

Figures 3, 4:
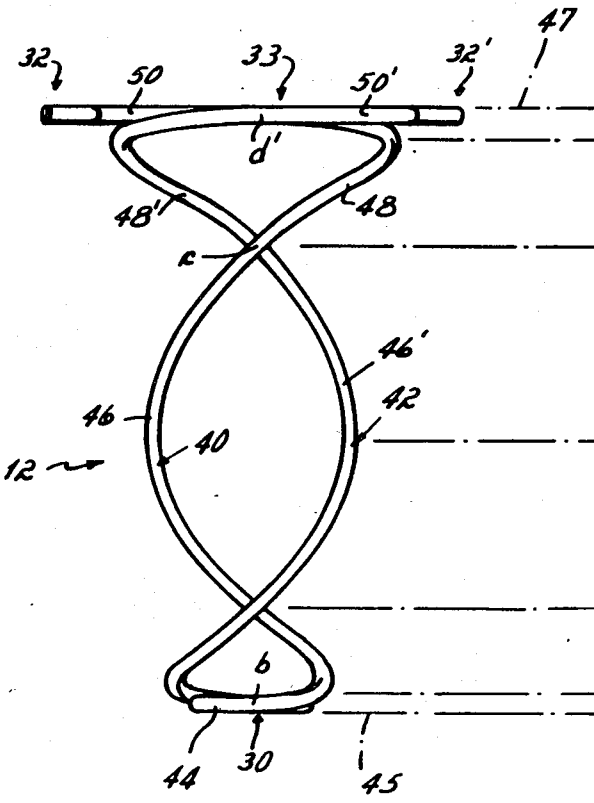
FIG. 3 is a side elevational view of one coil spring of the box spring assembly illustrated in FIG. 2.
FIG. 4 is a chart of the pitch and rise per quarter turn of revolution of the spring of FIGS. 2 and 3.
Figure 5:
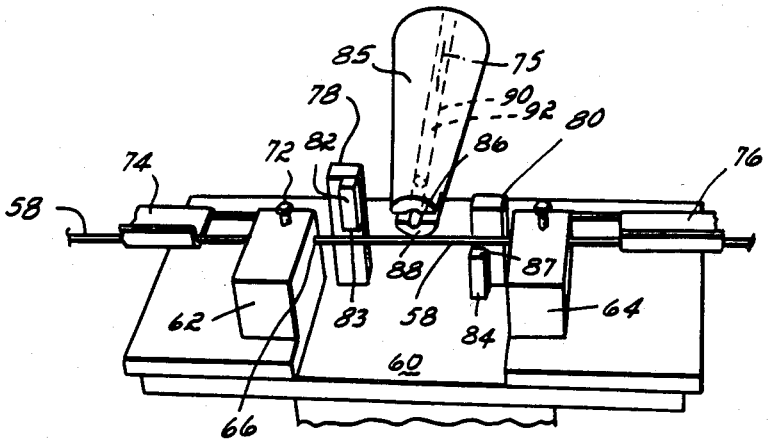
FIGS. 5–10 are perspective views of the method steps employed in the manufacture of the coil spring of FIGS. 2 and 3.
Figure 6:
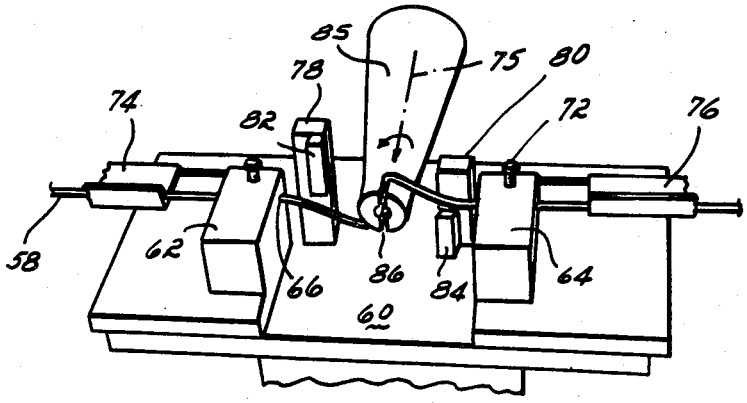
Figure 7:
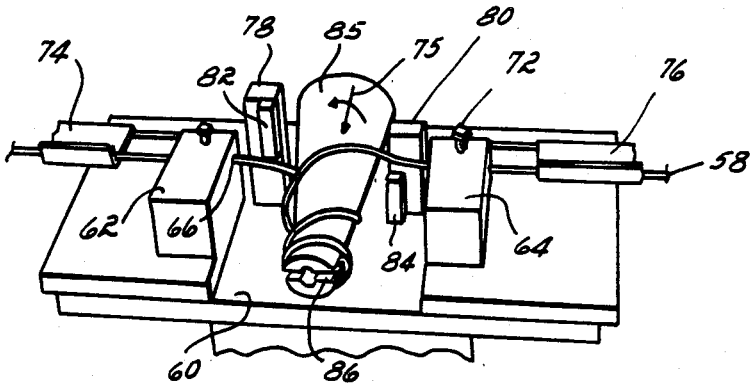
Figure 8:
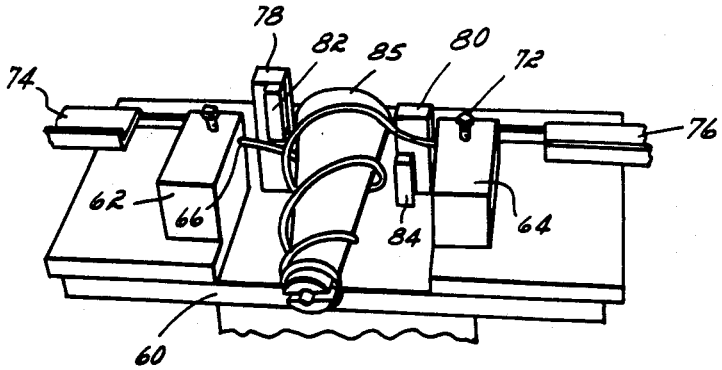
Figure 9:
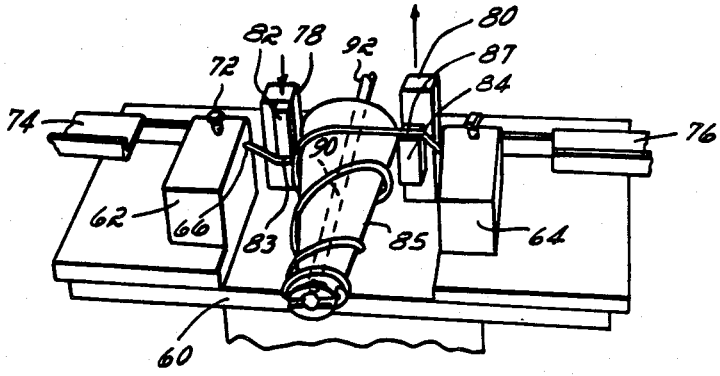

As best seen in FIGS. 2 and 3, each coil spring 12 comprises a bottom straight cross bar 38 from the opposite ends of which there extend upwardly a pair of vertical spring arms 40, 42. Each of these spring arms 40, 42 comprises four sections, a first flat arcuate section 44 of one quarter turn or revolution, a second active spring section 46 of one full turn or revolution, a third active spring section 48 of one-half turn, and a fourth flat connector section 50 of approximately one quarter turn or revolution. In order to distinguish between the different sections of the two spring arms 40, 42 and points on those arms, the sections of the spring arm 42 and points on the spring arm which correspond to sections and points on the arms 40 have been given the same identical numerical designation but followed by a prime mark.

The first flat arcuate section 44, 44' of each arm 40, 42 extends from the end a, a' of the cross bar 38 through approximately one quarter turn or revolution to a point b, b'. The cross bar 38 and the sections 44, 44' all reside in a common flat plane which is the plane of the top surface of the slats 22 and end boards 20 of the wooden frame. From the end b, b' of the first section 44, each spring arm 40, 42 extends upwardly through one full revolution to a point c, c'. These sections 46, 46' between the points b and c, and b' and c' rise approximately 4.3 inches from the plane 45 and follow a helical curve of increasing pitch. The third section 48, 48' of the spring arms 40, 42 extends from the point c, c' through approximately one-half revolution to a point d, d'. This section 48 from the point c, c' to the point d, d' rises approximately 1.2 inches from the point c, c' and follows a helical path of decreasing pitch and increasing diameter. The fourth section 50 of the spring arm, that which extends from the point d, d' to the end 32, 32' of the spring arm extends through approximately one quarter of a revolution and is located in the top plane 47 of the wire grid 16 of the spring assembly. This fourth section 50, 50' of each spring arm 40, 42 comprises a first arcuate portion which extends from the point d, d' to a point e, e' and a straight connector bar section 53, 53' which terminates in an outwardly bent short straight section 54, 54'. The straight connector bar section 53, 53' of each arm is the section of the spring which extends through the U-shaped hook 34 of the wire grid and is secured therein by having the end of the hook 34 bent over beneath the straight bar section 53, 53'.

It is to be noted that each spring arm 40, 42 of a coil spring 12 is of the same hand or otherwise expressed, rotates in the same direction. When viewed in top plan, both spring arms rotate in a clockwise direction as may be seen most clearly in FIGS. 1 and 2. It is further to be noted that each spring arm has one and a half active spring turns or revolutions of active compressible spring. That is, each spring arm 40, 42 has one and one-half revolutions of active compressible spring material between the points b and d in the second 46 and third 48 sections of the spring arm, and each arm has one full revolution of active spring between the points b and c wherein the helically wound spring is of increasing pitch and increasing diameter. Additionally, each spring arm has approximately one-half revolution of spring in the third section 50 between the points c and d which is of decreasing pitch.

With continued reference to FIGS. 2 and 3, it will be seen that the bottom one half revolution of each of the spring arms 40, 42 together form a bottom turn or convolution 30 of the coil spring 12 which is substantially all located in the top plane of the base frame 10. Similarly, the top one half turn of each of the spring arms 40, 42 together form a top turn or convolution 33 of the coil spring 12 which is substantially all located in the plane of wire grid 26. Since most bedding springs are between approximately 5½ and 6 inches in height, in the preferred embodiment the length of the increasing pitch spring arms 40, 42 between the two end convolutions 30, 33 is approximately 5½ inches.

With reference to FIG. 4, there is a chart of the rise and pitch of the spring of FIGS. 2 and 3 relative to each quarter turn or quarter revolution of the spring. As is evident from this chart, during the first quarter turn of the spring arms 40, 42 or from the point a, a' to the point b, b' of each arm, the arm is flat and remains in the plane 45. During the next quarter turn of the arms 40, 42 from the points b, b', the pitch of the helical wire is 0.784 inches per revolution and the spring arms rise 0.196 inches from the plane 45 during this one quarter turn. During the next quarter turn or quarter revolution of the spring, the pitch increases to a pitch of 3.14 inches per revolution and the rise of the spring arms 40, 42 during the third quarter turn of the arms is 0.785 inches. The pitch of the arms 40, 42 continues to increase for the first full revolution of the arms from the point b, b' at which the arms move out of the plane 45. The pitch increases to a maximum of 7.14 inches per revolution at the point c, c' after which it decreases in pitch to the top of the spring. After one and one quarter turns of the arms 40, 42, the accumulative rise of the spring arms is 4.291 inches so the point c is 4.291 inches above the plane 45. After one and three quarters turns of the spring arms 40, 42, the springs are 5½ inches or their full height above the plane 45.

The coil spring 12 described hereinabove has been found to have numerous advantages over more conventional knotted coil springs. Specifically, this coil spring has been found to be characterized by substantially less material than comparable conventional knotted coil springs of the same durability, resiliency, and firmness. This coil spring also has been found to be capable of manufacture by machinery which is much faster acting and much less expensive than the machinery required to manufacture torsion bar springs or so-called "formed wire springs" of comparable durability, resiliency, and firmness.

With reference now to FIGS. 5–9, there is illustrated the method by which the spring 12 is manufactured in a single station of a relatively inexpensive machine. With reference now to FIGS. 5–12, it will be seen that the machine upon which the coil spring 12 is manufactured comprises a supporting table 60 upon the top of which there is mounted a pair of spaced die blocks 62, 64. Each of these die blocks has a colinearly aligned bore 66, 68 extending therethrough and sized to receive a forming tube 73 therein. These forming tubes each have an internal bore sized to receive a straight length of wire 58 from which the coils 12 are to be formed. Each of the bores 66, 68 is intersected by a tapped bore 70 within which there is mounted a set screw 72. These set screws 72 function to secure the forming tubes 73 within each of the bores 66, 68.

Spaced outboard from each of the die blocks 62 there is a pair of V-shaped guide troughs or angle bars 74, 76, the bottoms of which are aligned with the bores 66, 68 in the die blocks 62, 64.

Located inboard from each of the die blocks 62, 64 there are vertically movable die blocks 78 and 80, respectively. One of these die blocks 78 has a forming die 82 extending forwardly from its front face above the plane of a wire 58. The other movable die block 80 has a forming die 84 extending forwardly from its front face and located beneath the wire 58.

Mounted between the vertically movable die blocks 78, 80 there is a rotatable and axially movable tapered mandrel 85. This mandrel is shaped as a truncated cone and has a shallow transverse slot 86 extending rearwardly from its front face 88. This mandrel also has an axial bore 90 extending therethrough within which a coil discharge rod is axially movable.

Figure 12:
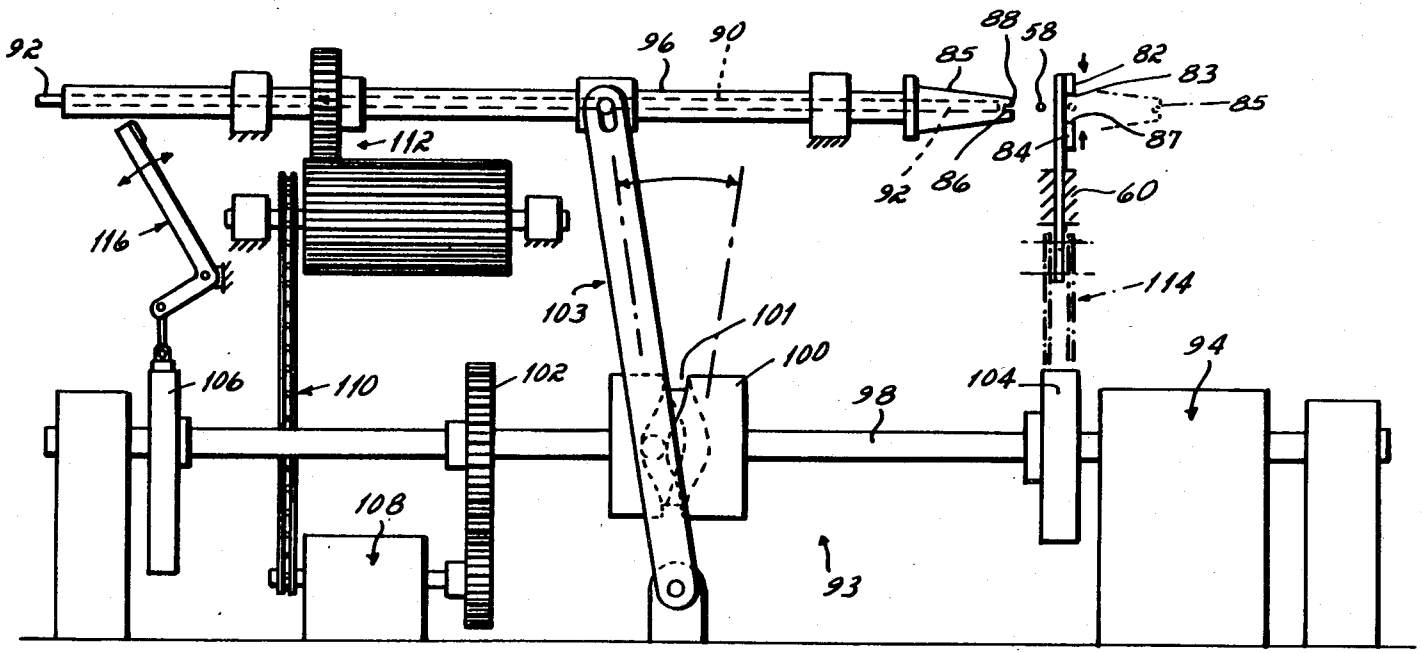
FIG. 12 is a partially diagrammatic side elevational view of the apparatus utilized in the practice of the method illustrated in FIGS. 5–10.

With reference now to FIG. 12 there is illustrated diagrammatically the mechanism for effecting rotary as well as axial longitudinal indexing movement of the mandrel 85, as well as axial movement of the rod 92 relative to the mandrel. To effect this mandrel 85 and rod 92 movement, a drive unit 93 is mounted beneath the mandrel supporting shaft 96. This drive unit comprises a motor and gear unit 94 operable to drive an output shaft 98. Upon the drive shaft 98 is fixedly mounted a barrel cam 100, a drive gear 102, and a pair of rotary cams 104, 106. The drive gear 102 is operative to drive an indexing unit 108 which in turn is operable through a chain and sprocket drive 110 to drive a gear 112 fixedly attached to the mandrel drive shaft 96. During the course of a coil forming cycle of the drive unit 93, the cam 100 is operative through a cam slot 101 and connected linkage 103 to effect controlled axial displacement of the mandrel supporting shaft 96. The rotary cam 104 in turn controls vertical movement of the cam blocks 78 and 80 through an appropriate linkage 114 and the rotary cam 106 controls axial movement of the shaft 92 through a bell crank linkage 116. The configuration of the cams 100, 104, 106 as well as the details of the linkage between these cams and the movable elements controlled by the cams have not been illustrated in detail in this application since those details can readily be supplied by a person skilled in this art.

With reference now to FIGS. 5–12, it will be seen that a coil 12 is manufactured by inserting a predetermined length of straight wire 58 into the bores 66, 68 of the die block 62, 64. To effect this insertion of the length of wire 58 into the bores, the wire is placed in the bottom of one of the troughs 74, 76 and pushed from that trough through the tubes 73 in the coaxially aligned bores 66, 68 into the other trough until the end of the wire engages a stop (not shown) at the end of the second trough. In this position of the wire 58, the mid-point of the wire is aligned with and intersects the axis 75 of the mandrel 85. The motor drive 94 is then actuated so as to effect an indexing cycle of the indexing unit 108 and simultaneously effect one full rotation of the rotary cams 110, 104 and 106. Upon initiation of this coil forming cycle, the mandrel 85 is moved forwardly by the cam 100 and linkage 103 until the middle section of the wire 58 is received within the transverse slot 86 in the forward face of the mandrel. Rotation of the mandrel is then initiated by the indexing unit 108 and connecting drive 110, 112 while simultaneously axial movement of the mandrel is continued under the control of a cam groove 101 contained within the periphery of the barrel-shaped cam 100. As a consequence of this simultaneous forward axial movement and rotation of the mandrel, the wire 58 is caused to be drawn through the bores of the tubes 73 in the stationary die blocks 62, 64 and to be wrapped about the mandrel as may be most clearly seen in FIGS. 6 and 7. The cam groove 101 in the barrel 100 is so configured that after approximately the first quarter turn or quarter revolution of the mandrel, the axial velocity of the mandrel is steadily increased for approximately the next full revolution of the mandrel and the resulting pitch of the wire wrapped about the mandrel is increased during this next first full revolution of the mandrel. During approximately the next one-half revolution of the mandrel, the axial velocity of the mandrel is decreased so as to generate the third decreasing pitch section 48 of the coil spring. During the last quarter turn of the mandrel there is no axial movement of the mandrel. After the mandrel has stopped rotation at the completion of a two full revolution coil 12, the die blocks 78, 80 are actuated. As a consequence of this actuation, the die block 78 is moved downwardly while the die block 80 is moved upwardly. This results in the bottom surface 83 of the die block 82 engaging the top surface of the wire 58 and causing that wire to be pushed downwardly. In this way the outwardly bent end 54 is formed on the free end 32 of the spring arm 40 of the spring. While the die block 78 is moving downwardly, the die block 80 is moving upwardly. As a consequence of this upward movement of the die block 80, the top surface 87 of the die 84 engages the wire 58 and causes that wire to be pushed upwardly. This die movement results in the outwardly bent end section 54' being formed on the free end 32' of the spring arm 42.

Figure 10:
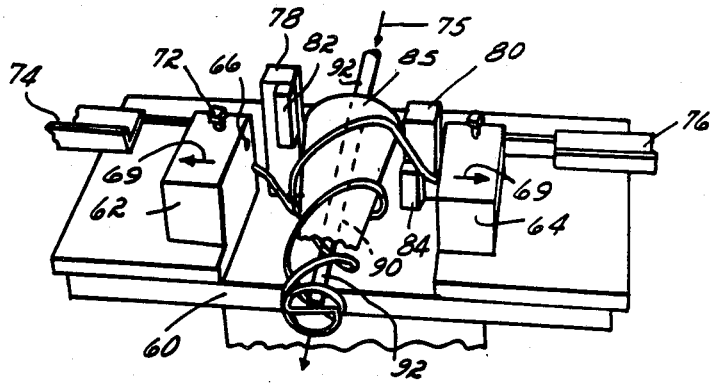
Figure 11:
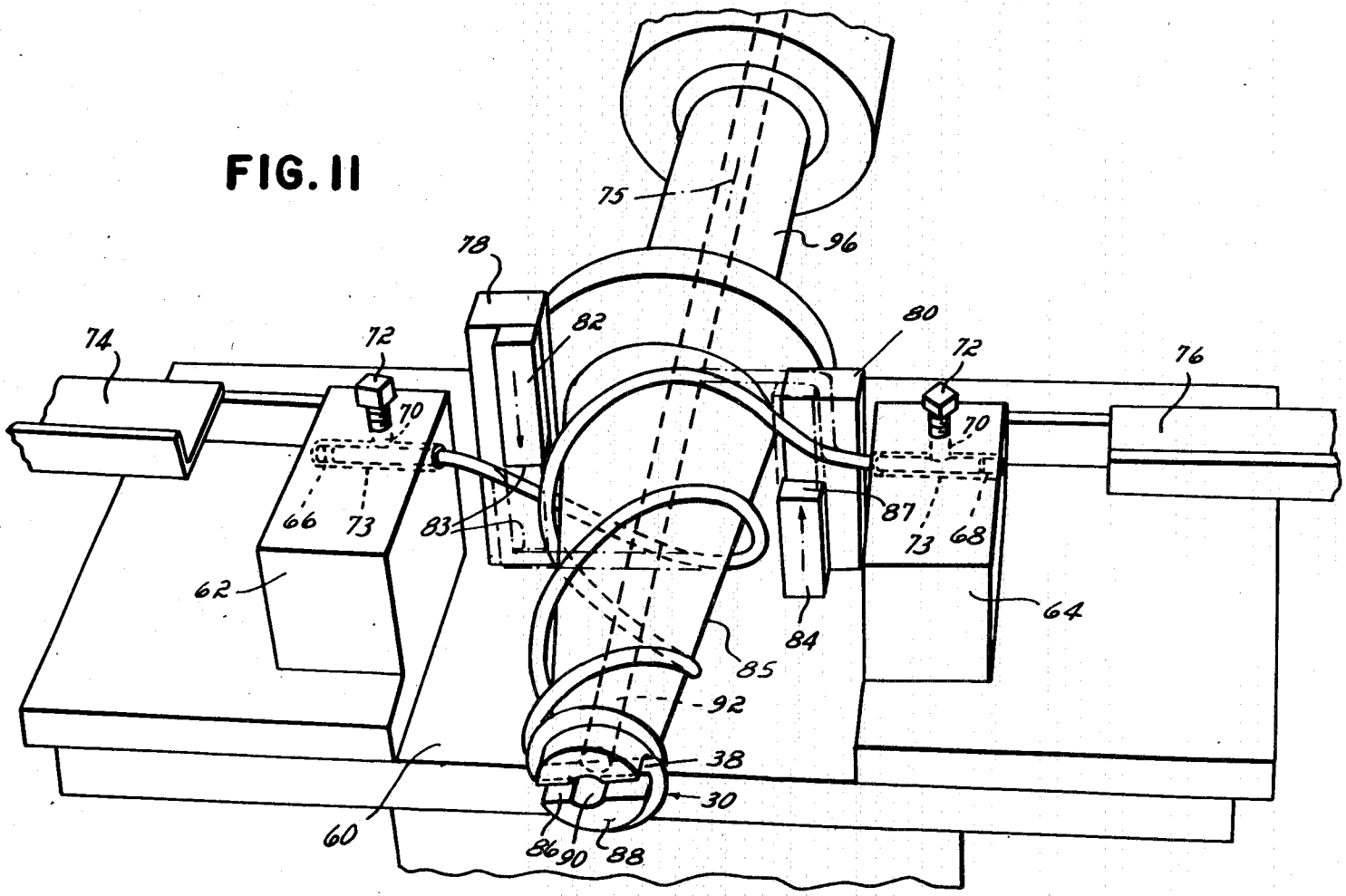
FIG. 11 is an enlarged perspective view of the method step illustrated in FIG. 9.

At the conclusion of the upward stroke of the die block 82 and the simultaneous downward stroke of the die block 80, the ends 32, 32' of the wire 58 are disengaged from the tubes 73 within the bores 66, 68 of the die blocks 62, 64 by transverse movement of the die blocks 62, 64 indicated by the arrows 69 in FIG. 10. As a consequence of this last movement of the die blocks 62, 64, the now completely formed coil spring 12 is free to be moved axially forwardly off of the mandrel. To effect this movement, the rotary cam 106 through the actuating mechanism 116 causes the rod 92 to be pushed forwardly through the axial bore 90 in the shaft 96 and mandrel 85. The forward end of that rod 92 then engages the middle section 38 of the formed coil spring and pushes that formed spring off of the mandrel onto a gravity feed chute through which the spring is carried away from the forward end of the machine.

Throughout the description of FIGS. 5–10 and the method by which the coil spring 12 is manufactured, the mandrel 85 has been described as being rotated and moved axially relative to the die blocks 62, 64 to effect helical wrapping of the wire 58 about the mandrel 85. It should be appreciated that the mandrel need not be rotated relative to the stationary die blocks 62, 64. Instead, the die blocks may be rotated relative to the stationary mandrel with the same result. Similarly, the mandrel has been described as being axially movable relative to the die blocks 62, 64 during the helical wrapping of the wire 58 about the mandrel. Alternatively though, the die blocks 62, 64 may be moved axially relative to the stationary die blocks. All that is critical to the practice of the method of this invention is that the wire 58 supporting die blocks 62, 64 be simultaneously rotated and moved axially relative to the mandrel. It is unimportant whether the relative rotation and axial movement is effected by the die blocks 62, 64 moving relative to the mandrel 85 or the mandrel moving relative top the die blocks.

The primary advantage of the practice of the method described hereinabove and the machine used in the practice of this method is that it enables a double twist or double spring arm coil spring to be very easily and inexpensively created in a single station of a forming machine. As explained hereinabove, the practice of this method results in the generation of a coil spring 12 which has many advantages over conventional prior art knotted coil springs or even over prior art formed wire springs.

In the use of the coil springs 12 to manufacture the box spring of FIGS. 1 and 2, the small diameter end loops 30 of the coil springs are first stapled to the tops of the slats 22 or to the tops of the end boards 20. The preassembled top wire grid 16 is then fitted over the top of the assembled wooden frame and springs 12 so as to locate the straight connector sections 53 of the free ends of the vertical spring arms 40, 42 within the U-shaped recesses 35 of the hooks 34 in the transverse wires 27 of the grid. The hooks are then crimped shut so as to secure the wire grid to the free ends of the vertical spring arms of each coil spring 12. To complete the box spring assembly, a conventional fabric pad 6 is overlaid over the top of the welded wire grid and the complete assembly, including the rectangular wooden frame, the springs 12, the top wire grid 16, and the fabric pad 6 are enclosed within a conventional upholstery covering 7.

It should be appreciated that while the novel coil springs 12 have been illustrated herein as being embodied in a box spring or bedding foundation, these same springs or modifications thereof may be utilized in spring mattresses as well. Additionally, these same springs may be incorporated into seats and particularly into automotive seats.

While we have described only a single preferred embodiment of our invention, persons skilled in this art will appreciate numerous changes and modifications which may be made without departing from the spirit of our invention. As an example, this same manufacturing method and apparatus may be utilized to generate springs of other configurations than single cone configurations and may be used to generate springs having differing free end configurations on the vertical spring arm. Furthermore, it should be appreciated that while one specific spring 12 has been described and dimensioned in detail, the principles are inventive aspects of the spring and are applicable to other springs, as for example springs of other heights, other numbers of turns or revolutions, and other helical pitches. Therefore, we do not intend to be limited except by the scope of the following appended claims.

We claim:

1. A method of manufacturing a double twist coil spring for use in a bedding or furniture product, which method comprises, inserting the middle section of a straight length of wire into a rotatable mandrel such that the end sections of the wire extend outwardly from opposite sides of the mandrel, restraining said end sections of said wire against rotation while rotating said mandrel and said middle section of said wire and while effecting axial movement of said middle section relative to said end sections so as to progressively wrap said end sections about said mandrel and create a coil spring having a diametrically extending middle section and a pair of end sections coiled in the same rotational direction from opposite ends of said middle section, and increasing the velocity of said axial movement of said mandrel relative to the velocity of said rotational movement over a major portion of the length of said axial movement so as to create a helical double twist coil spring of increasing pitch over a major portion of the length of said coil.

2. The method of claim 1 which further comprises the step of forming straight flats on the ends of said end sections remote from said middle section.

3. A method of manufacturing a double twist coil spring for use in a bedding or furniture product, which method comprises, inserting the middle section of a straight length of wire into a mandrel and the end sections of the wire through apertures of die blocks located on opposite sides of the mandrel, effecting relative rotation between said mandrel and aid die blocks while simultaneously effecting relative axial movement between said mandrel and said die blocks so as to progressively wrap said end sections of said wire about said mandrel and create a coil spring having a diametrically extending middle section and a pair of end sections coiled in the same rotational direction from opposite ends of said middle section, and increasing the velocity of said axial movement of said mandrel relative to the velocity of said rotational movement over a substantial portion of the length of said axial movement so as to create a helical double twist coil spring of increasing pitch over a substantial portion of the length of said coil.

4. The method of claim 5 which further comprises the step of forming straight flats on the ends of said end sections remote from said middle section by engaging each of said end sections with one of a pair of forming dies at a location between said die blocks and said mandrel and moving said forming dies in a direction substantially perpendicular to said axial movement.

5. Apparatus for manufacturing a double twist coil spring for use in a bedding or furniture product, which apparatus comprises, a rotatable mandrel, means on said mandrel for engaging the middle section of a straight length of wire such that the end sections of the wire extend outwardly from opposite sides of the mandrel, means engageable with said end sections of said wire for restraining said end sections against rotation while said middle section is rotated by said mandrel, means for effecting axial movement of said mandrel and said middle section of said wire relative to said end section restraining means so as to progressively wrap said end sections about said mandrel and create a coil spring having a diametrically extending middle section and a pair of end sections coiled in the same rotational direction from opposite ends of said middle section, and means for increasing the velocity of said axial movement relative to the velocity of said rotational movement over a substantial portion of the length of said axial movement so as to create a helical double twist coil of increasing pitch over a substantial portion of the length of said coil.

6. The apparatus of claim 5 which further comprises means for forming straight flats on the ends of said end sections remote from said middle section.

7. The apparatus of claim 5 wherein said restraining means comprises a pair of stationary dies each of which has an aperture therein through which said wire is drawn onto said rotating mandrel.

* * * * *

UNITED STATES PATENT AND TRADEMARK OFFICE

CERTIFICATE OF CORRECTION

PATENT NO. : 4,682,394

DATED : July 28, 1987

INVENTOR(S) : Thomas J. Wells and Angelo Serafini

It is certified that error appears in the above-identified patent and that said Letters Patent is hereby corrected as shown below:

Column 10, line 34, change "aid" to --said--.

Column 10, line 48, change "5" to --3--.

Signed and Sealed this

Twenty-ninth Day of March, 1988

*Attest:*

DONALD J. QUIGG

*Attesting Officer*

*Commissioner of Patents and Trademarks*